United States Patent [19]

Vollmer

[11] 4,202,085

[45] May 13, 1980

[54] APPARATUS AND METHOD FOR INSTALLING ROWS OF U-SHAPED TUBES IN A HEAT EXCHANGER

[75] Inventor: Regis R. Vollmer, Penn Township, Allegheny County, Pa.

[73] Assignee: Westinghouse Electric Corp., Pittsburgh, Pa.

[21] Appl. No.: 965,017

[22] Filed: Nov. 30, 1978

[51] Int. Cl.[2] ..... B23P 15/26

[52] U.S. Cl. ..... 29/157.3 C; 29/726; 269/43; 269/287

[58] Field of Search ..... 269/37, 43, 44, 287; 29/157.3 C, 281.1, 726

[56] References Cited

U.S. PATENT DOCUMENTS

| | | | |
|---|---|---|---|
| 918,816 | 4/1909 | Bartlett | 269/44 |
| 1,350,236 | 8/1920 | Pierce, Jr. | 269/37 |
| 1,481,169 | 1/1924 | Witte | 29/726 |
| 3,128,736 | 4/1964 | Norris et al. | 269/43 |
| 3,813,749 | 6/1974 | Peake et al. | 269/287 |

*Primary Examiner*—Lowell A. Larson
*Attorney, Agent, or Firm*—F. J. Baehr, Jr.

[57] ABSTRACT

A support assembly for two rows of U-shaped tubes comprises a U-bend rack which aligns and holds the U-bend portions of the tubes in a plurality of leg racks which align and hold the straight leg portions of two rows of tubes, the support assembly is utilized in inspecting shipping and simultaneously installing two rows of tubes in a vertically oriented heat exchanger.

11 Claims, 16 Drawing Figures

APPARATUS AND METHOD FOR INSTALLING ROWS OF U-SHAPED TUBES IN A HEAT EXCHANGER

BACKGROUND OF THE INVENTION

1. Field of the Invention

This invention relates to heat exchangers and more particularly to the simultaneous installation of rows of U-shaped tubes into heat exchangers.

2. Description of the Prior Art

U-shaped tubes are in common use and are installed one tube at a time with the tube sheets vertically oriented and the tubes disposed horizontally as they are slit through the holes in the support plates. Installing complete rows of horizontal tubes has been tried but was not successful as the frictional force between the tubes and the support plates made it difficult to slide the complete rows of tubes through the support plates and into the tube sheet. U-shaped tubes are often manufactured at one plant and installed in heat exchanger in another location this is particularly true when a large number of special alloyed tubes are involved. Shipping containers for the tubes are normally wooden crates, which subject the tubes to frequent damage from nails and from bending and denting as the crates are easily damaged when handling with large mechanical equipment as is required, when the tubes are long.

Another problem stemming from the normal manufacture process of bending the tubes at one location and installing them in a heat exchanger at a distant location is if the tubes are not properly bent this will not be discovered until they are being installed in the heat exchanger.

In a plant where several heat exchangers are being built, a damaged tube can be replaced by borrowing a tube from another job, however, in a field retubing application extra assurance is required to insure that all the tubes are of the proper size and none are damaged during the crating and shipping operation as there are no spare tubes at the site and a damaged tube would seriously delay the retubing operation.

SUMMARY OF THE INVENTION

In general, a support assembly for holding and aligning at least one row of U-shaped tubes having a U-bend portion and straight legs extending therefrom, when made in accordance with this invention, comprises a U-bend rack which aligns and holds the U-bend portion of least one row of tubes in the relative positions in which the U-bends will be disposed when installed in the heat exchanger, a plurality of leg racks which align and hold the legs in the relative positions in which the legs will be disposed in the heat exchanger, and an eye attached to the U-bend rack for lifting the assembly with the tubes disposed therein. The racks with the tubes disposed therein are placed in a metal shipping crate having tubular sidewalls and special braces extending between the sidewalls which allow a filled crate to be lifted from one end and to be turned in any direction without damaging the tubes disposed therein. With the tubes in the rack, a complete row of tubes can be installed in a heat exchanger. The tubes are installed while oriented vertically keeping the frictional force between the tubes and the tube support sheets at a minimal level. This is particularly important if the support plates are formed from stainless steel or some other material which results in galling between the tubes and the support plate. The galling problem is accentuated when trying to install one or more complete rows of tubes at a time, thus, the apparatus and method hereinafter described are essential for simultaneously loading multiple rows of tubes in a heat exchanger.

BRIEF DESCRIPTION OF THE DRAWINGS

The objects and advantages of this invention will become more apparent from reading the following detailed description in connection with the accompanying drawings, in which.

DESCRIPTION OF THE PREFERRED EMBODIMENT

Figure 1:
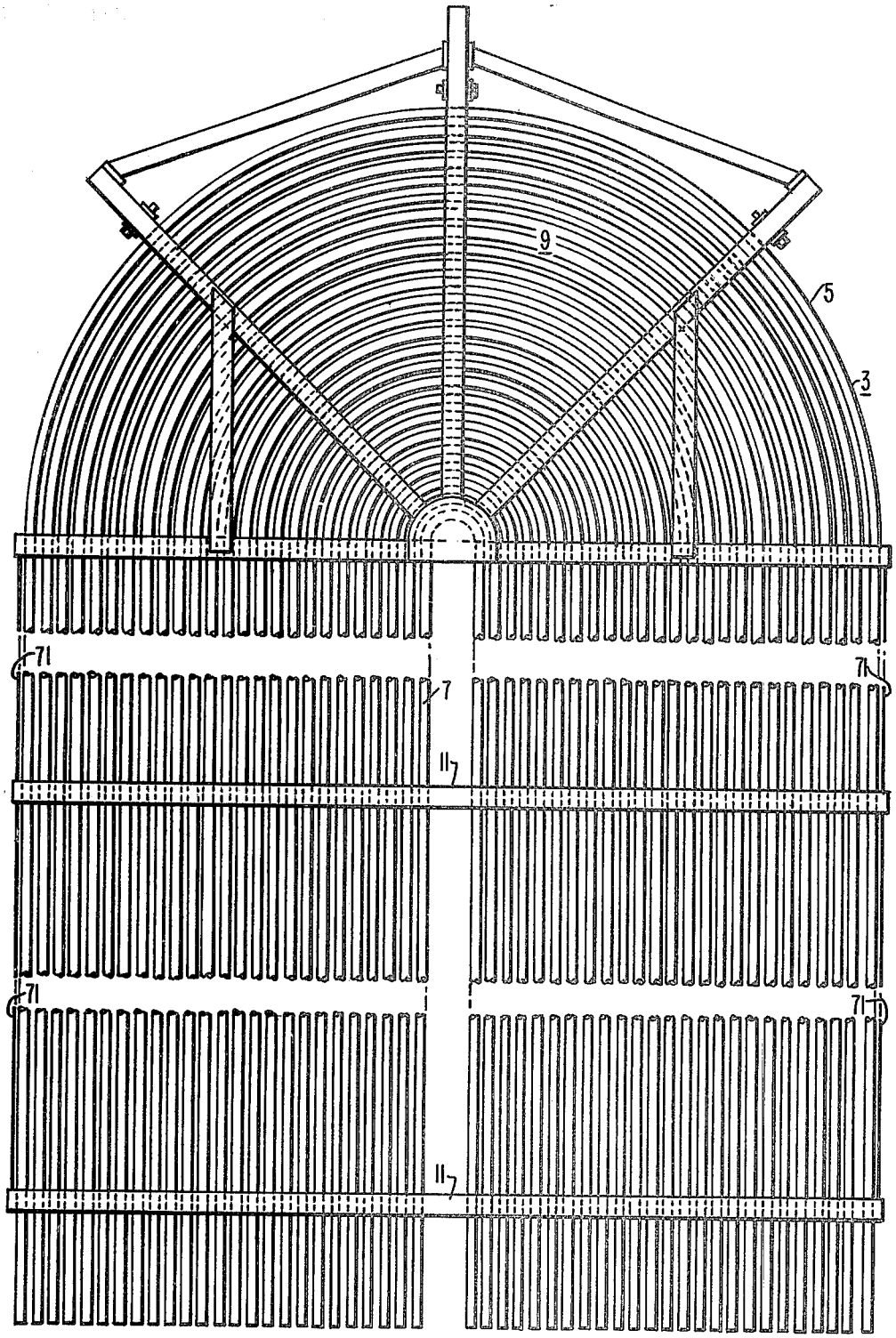
FIG. 1 is an elevational view of a support assembly for two rows of U-shaped tubes.

Referring now to the drawings in detail, and in particular to FIG. 1, there is shown an apparatus or support assembly 1 aligning and holding two rows of U-shaped tubes 3 having U-bend portions 5 of varying radii and straight leg portion 7 generally of the same length.

The apparatus or support assembly 1 comprises a U-bend rack 9 which aligns and holds the U-bend portion 7 of tubes 3 of varying radii in the relative positions in which they are to be disposed in the heat exchanger (not shown) and a plurality of leg racks 11 which align and hold the legs 7 of the U-shaped tubes 3 in the relative positions in which they are disposed in the heat exchanger.

Figure 2:
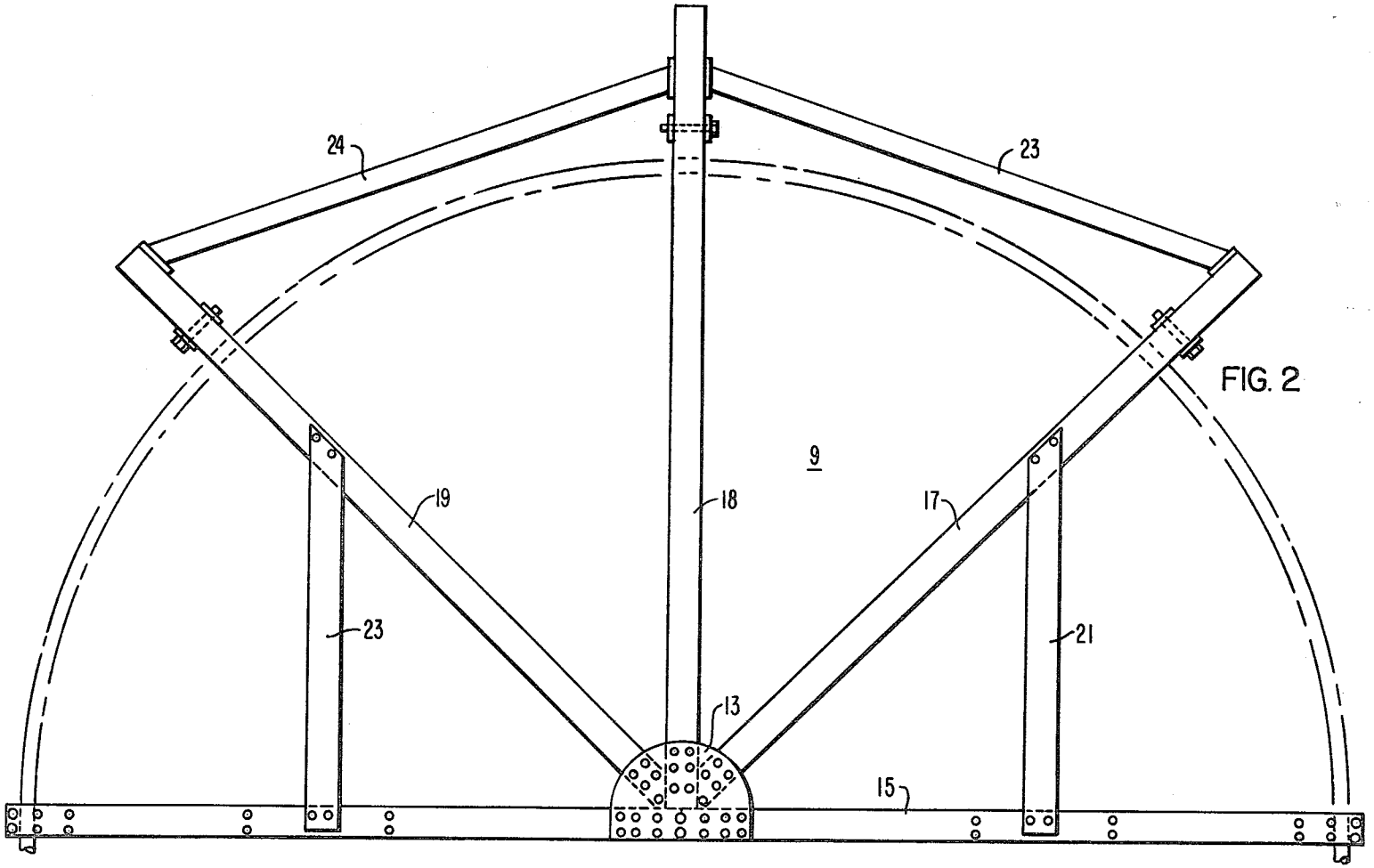
FIG. 2 is an elevational view of a U-bend rack for supporting the U-bend portion of two rows of U-shaped tubes.

As shown in FIG. 2, the U-bend rack 9 comprises a plurality of elongated members disposed in a semicircular spider web-like arrangement or array having a central hub 13, a cordal member 15, a plurality of radial members 17, 18 and 19, and connecting members 21, 22, 23 and 24 which join adjacent cordal or radial members utilizing bolts and nuts or other fastening means.

Figure 3:
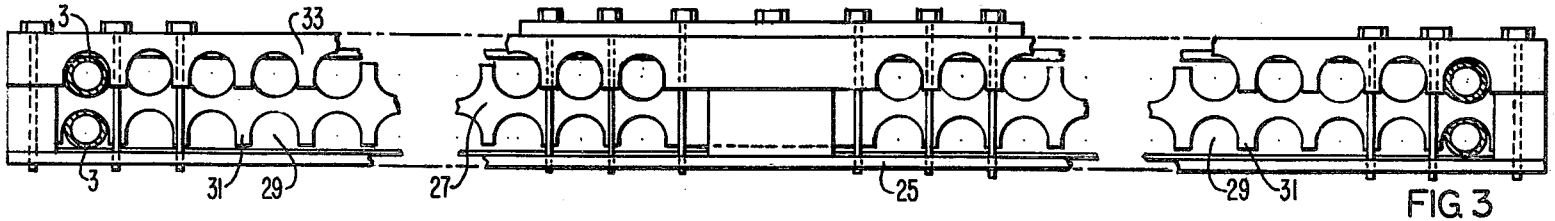
FIG. 3 is a sectional view taken on line III—III of FIG. 2.
Figure 4:
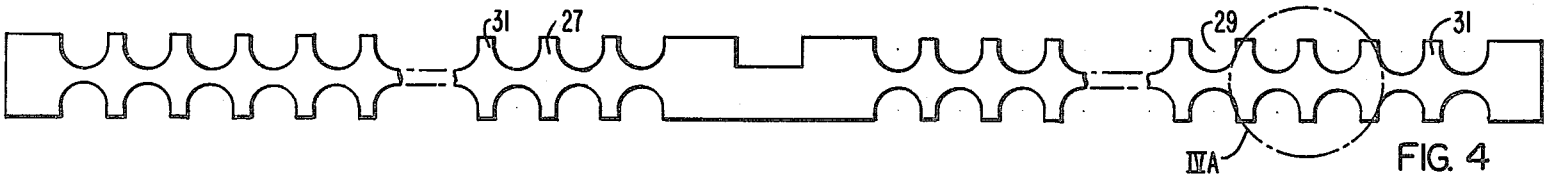
FIG. 4 is a plan view of an elongated member utilized in the U-bend rack.

As shown in FIG. 3, the cordal member 15 comprises a plurality of elongated members which include a flat elongated bar 25, which forms a part of a spider 26, an elongated bar member 27 with generally parallel margins and a plurality of grooves 29 extending inwardly from both margins to form a plurality of lugs 31 on opposite margins of the bar 27, and an elongated channel member 33.

Figure 13:
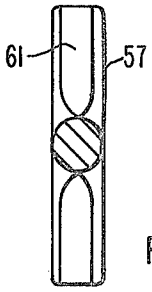
FIG. 13 is a sectional view taken on line XIII—XIII of FIG. 12.

The elongated bar 27 has chamfers or radii disposed about all sides of the groove 29 preventing sharp edges from coming in contact with the tubes 3 and allowing the bar 27 to be rotated 90° so that the bar 27 may be removed from between adjacent rows of tubes 3 when the tubes are in their relative positions within the heat exchanger. The disposition of the chamfers or radii may be seen in FIG. 13.

Figure 5:
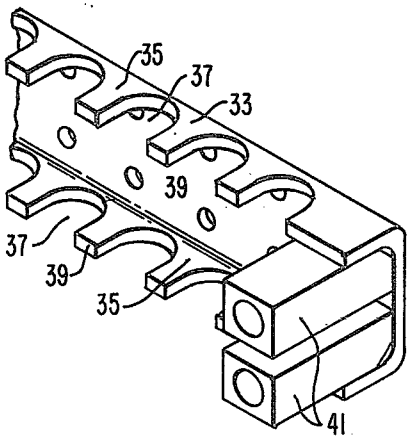
FIG. 5 is an isometric view of a portion of an elongated member utilized in the U-bend rack.
Figure 4A:
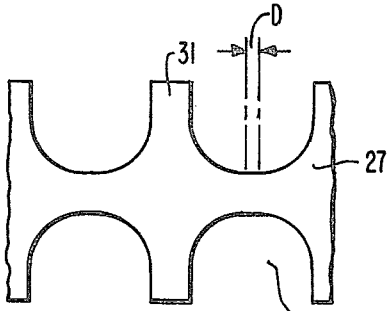

FIG. 5 shows the elongated channel member 33 having a generally U-shaped cross-section with generally parallel legs 35 extending the entire length thereof. The legs 35 have registering grooves 37 which will accept a straight leg portion 7 of the tubes 3. The grooves 37 form a plurality of lugs 39 which hold the tubes 3 in position. Spacers 41 are disposed on the ends of the channel member 33 to facilitate assembly of the three elongated members 25, 27 and 33 to form the cordal member 15.

Figure 6:
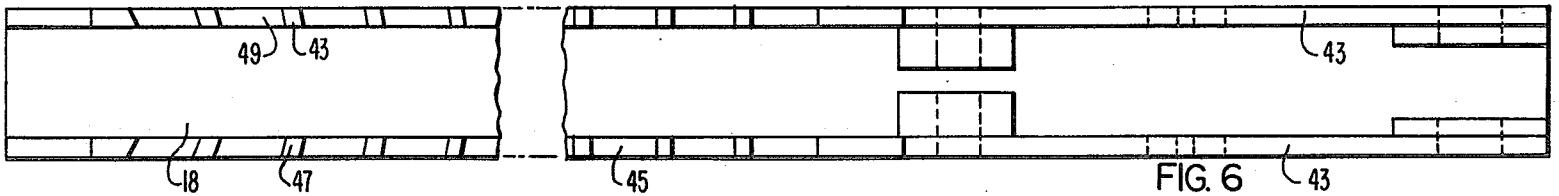
FIG. 6 is a plan view of an elongated member utilized in the U-bend rack.
Figure 7:
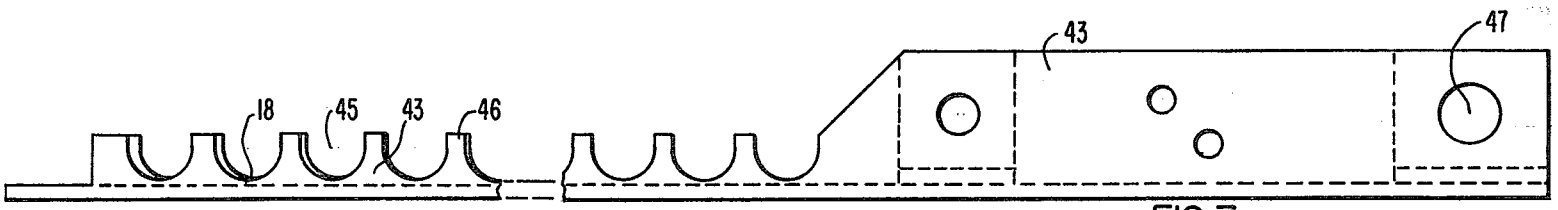
FIG. 7 is an elevational view of the elongated member shown in FIG. 6.
Figure 9:
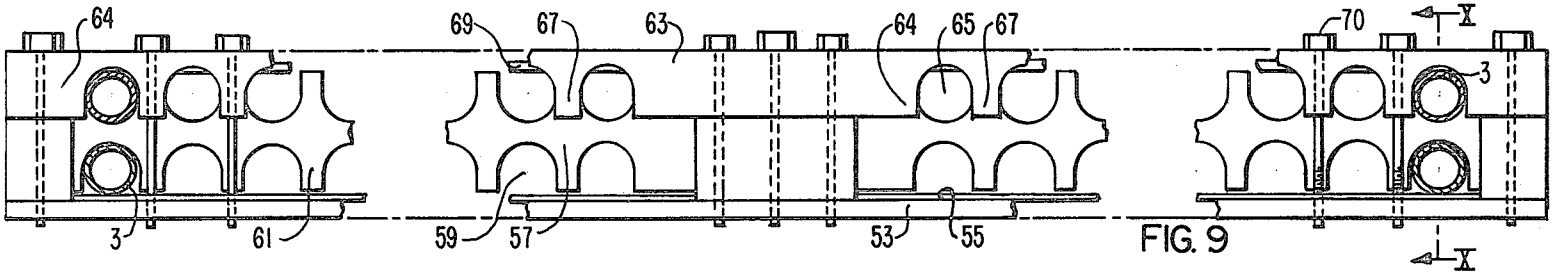
FIG. 9 is a plan view of a leg rack.
Figure 11:
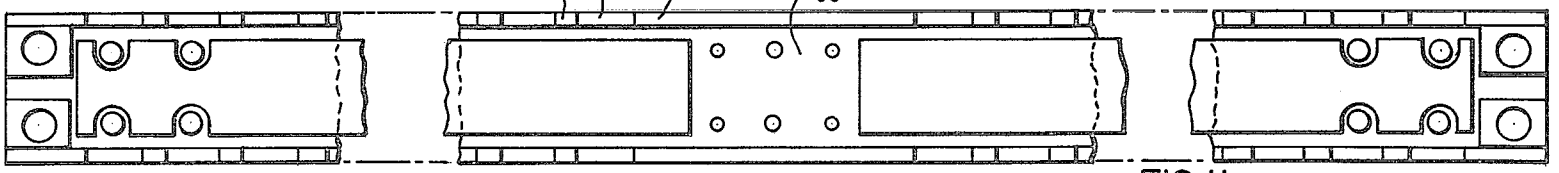
FIG. 11 is an elevational view of one elongated member utilized in a leg rack.

FIGS. 6 and 7 show one of the radial members 18 which is an elongated channel-shaped member with generally parallel legs 43 which have a plurality of registering grooves 49 disposed in each of the legs. The grooves 45 are disposed on increasing radii in order to accept the bent portion of tubes having varying radii. The grooves 45 form lugs 46 which position the bent portion 7 of the tubes 3. One end of the radial member 18 is detachably connected to the hub 13 while the other end is detachably connected to the connecting members 23 and 24. The other end of the radial member 18 has an opening or eye 47 for receiving the hook of a crane or hoist. The channel-shaped member mates with an elongated bar similar to the bar 27 with grooves extending inwardly from both margins and a flat bar 48 which is part of the spider 26 to capture two rows of tubes 3.

Figure 8:
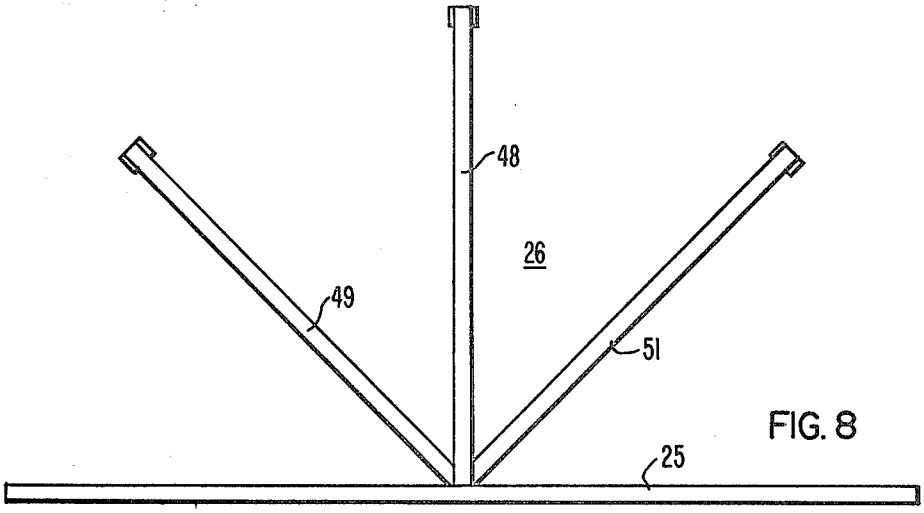
FIG. 8 is an elevational view of a spider utilized in the U-bend rack.
Figure 12:
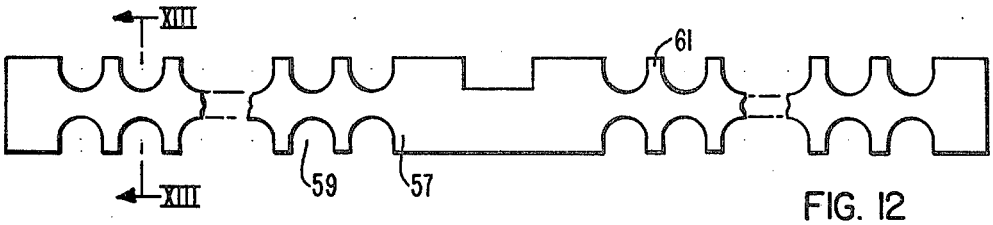
FIG. 12 is a plan view of another elongated member utilized in the leg rack.
Figure 10:
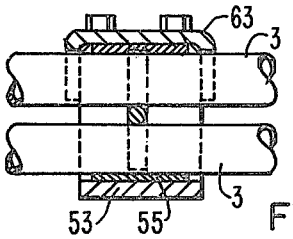
FIG. 10 is a sectional view taken on line X—X of FIG. 9.

The spider 26 is shown in FIG. 8 and comprises the flat elongated bar 25, three flat elongated bars 48, 49 and 51 disposed in a semicircular array with approximately 45° spacing. The bars are joined in a unitized structure radiating from the center of the elongated flat bar 25 forming a base to which the hub member and elongated members join to form the U-bend rack 9 which, when assembled utilizing bolts or other fasteners, will position the tubes to form two rows of tubes oriented as they would be in the heat exchanger.

FIGS. 9, 10, 11, 12 and 13 show the leg rack 11 which comprises a plurality of elongated members, a flat bar 53 with an elastomer strip 55, such as rubber, affixed to one surface thereof, a flat bar 57 with generally parallel margins and a plurality of registering grooves 59 which accept the straight legs 7 of the tube 53. The grooves 59 extend inwardly from the longitudinal margins of the flat bar 57 to form equally spaced lugs 61 which space the tubes at regular intervals. The leg racks 11 also comprise a channel-shaped member 63 having generally parallel legs 64 with a plurality of registering grooves 65 extending inwardly from the distal ends of the legs 64. The grooves 65 will accept the straight portion of the tubes 3. The grooves 65 cooperate to form lugs 67 which dispose the tubes in the proper spaced relationship for insertion into the heat exchanger. The inner surface of the channel-shaped member 63 has an elastomer strip 69 disposed thereon. The elastomer strips 55 and 69 cooperate to frictionally hold the leg racks 11 in position on the straight leg portion 7 of the tubes 3. Captured bolts 70 or other fastening means are utilized to assemble the elongated members to form the leg rack 11. A tether 71 or other means connects the U-bend rack 9 with the straight leg racks 11 to further prevent slipping of the straight leg racks 9 when the tubes 3 are vertically oriented.

Figure 14:
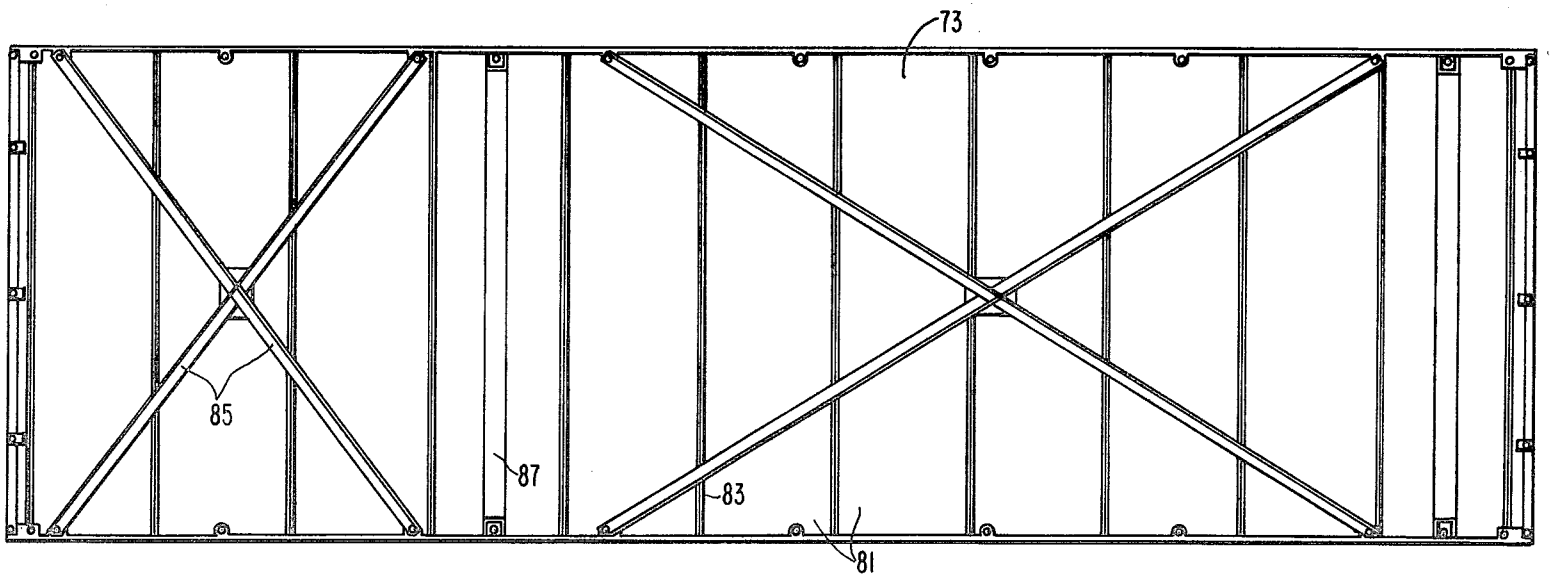
FIG. 14 is a plan view of a shipping and inspection container.
Figure 15:
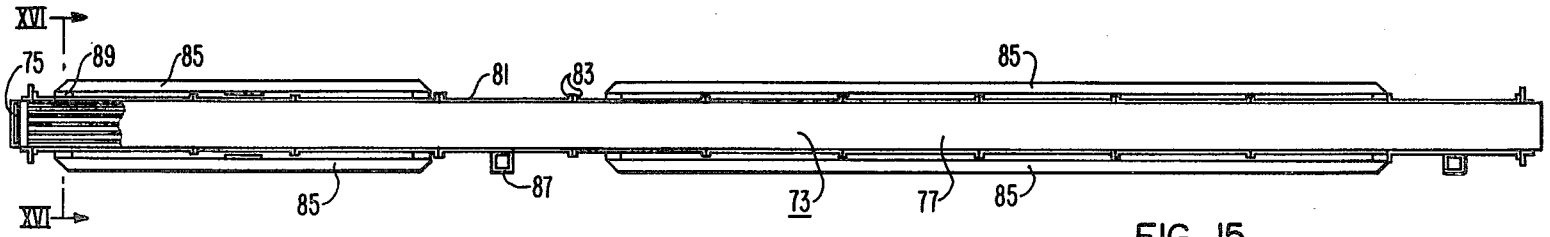
FIG. 15 is an elevational view of the shipping and inspection container.
Figure 16:
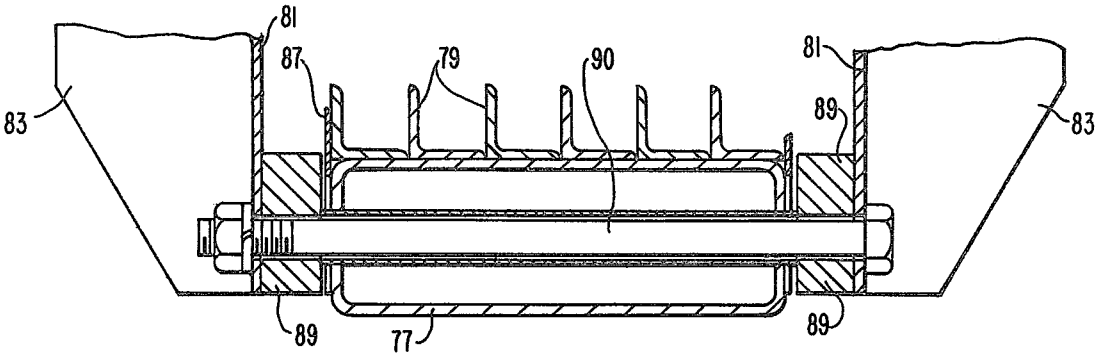
FIG. 16 is a partial sectional view taken on line XVI—XVI of FIG. 15.

FIGS. 14, 15 and 16 show a shipping crate 73 which receives the U-bend and straight leg racks 9 and 11 to provide a shipping container in which the tubes 3 are disposed in the positions in which they will be disposed when placed in the heat exchanger and which can be lifted from one end or moved in any position without damaging the tubes 3. The shipping crate 73 comprises tubular sides 75 and 77; the longer sides 77 have a plurality of angles 79 detachably fastened in a row for receiving a plurality of U-bend and leg racks 9 and 11. Each set of racks holds two rows of tubes 3. A plurality of cover plates 81 having flanges 83 longitudinally disposed along its margin are detachably fastened to the tubular sides 77 to enclose the racks and tubes. X-shaped braces 85 are disposed adjacent each end of the crate and are detachably connected to the tubular sides 77 and a transverse brace 87 is detachably disposed between the tubular side 77 adjacent the central portion of the crate. The X-braces 85 have a spacer 89 to raise the brace above the flanges 83 on the cover plates 81. The braces 85 are bolted to the tubular side plates 77 by a through-bolt 90.

To utilize the apparatus hereinbefore described, tubes 3 are bent to a plurality of varying radii in order to fit into a heat exchanger and form rows of various radii tubes. The bent tubes 3 are placed in the U-bend and leg racks 9 and 11, respectively, forming two rows of tubes, each row having tubes of varying radii U-bends. If the tubes fit into the U-bend rack and the leg racks and the ends are generally disposed in the single plane, the tubes 3 are bent properly and are of the proper length. The double rows and racks are placed in the crate 73 stacking them on the angles 79. When the appropriate number of double rows of tubes 3 are placed in the crate 73 the cover plates 81 are secured in place and so are the X-braces 85. The crates 73 are now ready for shipment and can be lifted from one end and turned in any direction without damaging the tubes 3 disposed therein allowing the crates to be maneuvered into the relatively small opening in a containment vessel for retubing a heat exchanger such as a nuclear steam generator. Once inside the containment, the crate 73 is lifted so that the tubes are vertically oriented. With the container vertically oriented, a rack and two rows of tubes 3 can be removed from the crate 73 and bullet-shaped guides (not shown) can be disposed in the distal ends of the tubes 3 to assist and guide them into the holes in the tube support plates. The tubes are raised to a position so that the guides are adjacent the proper holes in the support plates and the tubes are lowered into the holes until one of the leg racks approaches the upper support plate. The leg rack adjacent the support plate is removed by removing the elongated flat bar 53, the channel-shaped elongated member 63, and rotating the elongated bar 57 with the plurality of grooves 59 extending inwardly from the margin by twisting it approximately 90° so that it can be removed from between two rows of tubes 3 without disturbing the relative position of the tubes 3.

The flat bar 53 is oriented so that it is adjacent a row of tubes 3 already installed in the heat exchanger, thus it can be removed from between the rows of tubes 3. The elongated channel member 63 is oriented so that it is on the side away from rows already installed tubes 3, allowing it to move horizontally away from the tubes 3 being installed. Successively the tubes are lowered and leg racks 11 are removed until the bend rack 9 is adjacent the tube support plate and the ends of the tubes extend through the tube sheet. The spider 26 is disposed adjacent a row of tubes previously installed, since it can slip between installed rows of tubes. The "U"-shaped elongated members are removed and finally the bars extending inwardly from both longitudinal margins are removed and two more rows of tubes are in place in the heat exchanger.

I claim:

1. A support assembly for aligning and holding at least one row of U-shaped tubes having a U-bend portion and straight legs, said support assembly comprising a U-bend rack which aligns and holds the U-bend portion of at least one row of tubes in the relative positions in which the tubes are to be disposed in the heat exchanger, a plurality of leg racks which align and hold the legs of at least one row of U-shaped tubes in the relative positions in which the legs of the tubes are to be disposed in the heat exchanger, and means attached to said U-bend rack for lifting said support assembly and at least one row of tubes so that the legs of the tubes are generally vertically oriented when the support assembly and rows of tubes are lifted.

2. A support assembly as set forth in claim 1 wherein the U-bend racks align and hold the bent portion of two rows of U-shaped tubes in the relative positions which the U-bend portions of the tubes are to be disposed in the heat exchanger.

3. The support assembly as set forth in claim 1 wherein the U-bend rack comprises at least one member with a plurality of lugs disposed to align and hold the U-bend portion of the at least one row of U-shaped tubes in the relative positions in which they are to be disposed in the heat exchanger and the leg racks comprise at least one member with a plurality of lugs disposed to align and hold the straight legs of at least one row of U-shaped tubes in the relative positions in which the straight legs are to be disposed in the heat exchanger for the support assembly as set forth in claim 1, wherein the U-bend rack comprises at least one elongated member with a longitudinal margin and a plurality of grooves extending inwardly from the longitudinal margin, the grooves being shaped to receive a bent portion of the tube.

4. The support assembly as set forth in claim 2 wherein the U-bend rack comprises at least one elongated member with two straight generally parallel longitudinal margins and a plurality of grooves extending inwardly from the margins, the grooves registering and being shaped to receive a tube and to allow said elongated member to be rotated 90° so that it can be removed from between two adjacent rows of tubes without disturbing their relative positions.

5. The support assembly as set forth in claim 1 wherein the leg racks are connected to the U-bend rack.

6. The support assembly as set forth in claim 1 wherein the leg racks are connected to the U-bend rack by a tether.

7. The support assembly as set forth in claim 1 wherein the leg racks have means for frictionally holding the leg racks in place on the tubes when the tubes are vertically oriented.

8. The support assembly as set forth in claim 1 wherein the U-bend racks comprise a plurality of members with a plurality of lugs disposed to align and hold the U-bend portion of the row of tubes in the relative positions in which the tubes are to be disposed in the heat exchanger, a plurality of bars detachably connected to the member with lugs to form a rigid U-bend rack.

9. The support assembly as set forth in claim 8 wherein the members with a plurality of lugs is a channel with registering grooves on the legs of the channel to form the lugs.

10. A method of installing at least one row of U-shaped tubes in a heat exchanger utilizing a support assembly with a U-bend and leg racks which align and hold the tubes in the relative positions in which they will be disposed in the heat exchanger, said method comprising the steps of:

placing at least one row of tubes in the support assembly;

checking the row of tubes to make sure they are properly bent;

placing bullet-shaped guides in the ends of the tubes;

disposing the heat exchanger in such a position that the tubes are generally vertical;

lifting the support assembly and tubes and aligning the row of tubes with a proper row of holes in the heat exchanger;

lowering the support assembly and tubes slowly as the bullet-shaped guides enter the openings in the heat exchanger;

stopping the lowering operation as the lower leg rack approaches an upper tube support;

removing the lower leg rack from the legs of the tubes;

serially lowering and removing leg racks as the ends of the tubes extend downwardly through the tube sheet;

removing the bullet-shaped guides and fastening the tubes to the tube sheet; and removing the U-bend rack from the row of tubes.

11. A method of installing a plurality of rows of U-shaped tubes in a heat exchanger utilizing a support assembly with a U-bend and leg racks which align and hold the tubes in the relative position in which they are to be disposed in the heat exchanger, said method comprising the steps of:

placing a plurality of rows of tubes in the support assembly;

checking the rows of tubes to make sure they are properly bent;

placing bullet-shaped guides in the ends of the tubes;

disposing the heat exchanger in a generally vertical position;

lifting the support assembly and rows of tubes above the heat exchanger and aligning the rows of tubes with the holes in the support plates of the heat exchanger;

lowering the support assembly and tubes slowly as the bullet-shaped guides slide into the openings in the tube supports;

stopping the lowering operation as the lower leg rack approaches the tube support;

removing the lower leg rack from the legs of the tubes;

serially lowering and removing leg racks until the ends of the tubes extend through the tube sheet;

removing the bullet-shaped guides from the tubes and fastening the tubes to the tube sheet; and removing the U-bend racks from the rows of tubes.

* * * * *